US005626199A

United States Patent [19]

Henry et al.

[11] Patent Number: 5,626,199

[45] Date of Patent: May 6, 1997

[54] PNEUMATIC IMPACT TOOL HAVING IMPROVED VIBRATION AND NOISE ATTENUATION

[75] Inventors: Edgar G. Henry, Kirtland; Frank W. Schossler, Willoughby Hills; Donald K. Kuhl, Chesterland, all of Ohio

[73] Assignee: T.C. Service Company, Highland Heights, Ohio

[21] Appl. No.: 498,370

[22] Filed: Jul. 5, 1995

[51] Int. Cl.[6] ..... B25D 17/11

[52] U.S. Cl. ..... 173/211; 173/162.1

[58] Field of Search ..... 173/137, 162.1, 173/162.2, 206, 210, 211, 212

[56] References Cited

U.S. PATENT DOCUMENTS

| | | | |
|---|---|---|---|
| 3,456,744 | 7/1969 | Altschuler | 173/212 X |
| 4,310,055 | 1/1982 | Wanner et al. | 173/212 X |
| 4,402,369 | 9/1983 | Nikitin et al. | 173/162.1 X |
| 4,681,172 | 7/1987 | Mikiya et al. | 173/162.1 X |
| 4,723,610 | 2/1988 | Dummermuth et al. | 173/162.1 X |
| 5,117,923 | 6/1992 | Wuhrer | 173/210 X |
| 5,407,018 | 4/1995 | Henry | 173/211 |
| 5,417,294 | 5/1995 | Suher | 173/211 X |

*Primary Examiner*—Scott A. Smith
*Assistant Examiner*—Jay A. Stelacone
*Attorney, Agent, or Firm*—John F. McDevitt

[57] ABSTRACT

Vibration and noise are considerably reduced in a pneumatic impact tool by structure generating a novel vibration dampening action during tool operation. Dampening chamber members in the tool undergo compression when the reciprocating work member recoils as a method for such attenuation. Resilient seal members are further included in the tool construction to assist with the vibration dampening effect. Inclusion of oppositely biased spring members in the tool construction still further reduces the vibration attenuation.

14 Claims, 2 Drawing Sheets

PNEUMATIC IMPACT TOOL HAVING IMPROVED VIBRATION AND NOISE ATTENUATION

BACKGROUND OF THE INVENTION

This invention relates generally to a hand-operated pneumatic power tool having improved means for attenuation of both vibration and noise when being operated and more particularly to the construction of such type tool device which employs a reciprocating work member such as a chisel, hammer or the like.

Various means are already known to nullify or reduce considerable impact otherwise experienced by operators of pneumatic power tools, both hand-held and hand-operated, to include chippers, hammers, tampers, jack hammers and the like. In addition to requiring considerable strength to operate such tools, the continuous comparatively large amplitude impacting mechanical forces associated with the recoil reaction of the reciprocating work member often results in serious physical harm to the tool operator. Thus, there has long been a need for vibration attenuation in such pneumatic powered impact tools so that little if any cyclical impact forces will be transmitted to the tool operator. Likewise, various federal and state governmental agencies are becoming increasingly concerned with the serious need to reduce noise in the work place based on either health considerations for the work force or disturbance to the surrounding population.

Pneumatic dampening of the reciprocating work member has been employed as a known means to secure vibration attenuation for a variety of such impact tools. For example, such pneumatic attenuation means are disclosed in U.S. Pat. No. 3,456,744 whereby the recoil of a free piston member in such type device is dampened with a pneumatic counterforce. As therein described at the time the piston starts backward movement there is gas pressure between the forward face of the piston and the tool member tending to drive the piston backward. The volume between the rear of the piston and the closed end of a movable sleeve member is vented to the atmosphere. As the piston moves backward the movable sleeve member moves forward under gas pressure in a peripherally located chamber between said sleeve member and a further tool member in the device and between the forward face of the piston and the sleeve member. As the sleeve member moves forward, the passage is closed thereby trapping gas between the rear face of the piston and the closed end of the sleeve member. Also, the volume between the piston and tool bit is closed thereby retaining the gas therein which expands as the piston moves to the rear. Compression of the gas in the volume between the rear Face of the piston and the closed end of the sleeve member tends to decelerate both the piston and the sleeve member without imparting cyclic recoil forces to the tool member, barrel member or the handle in said device. A similar vibration dampening mechanism is described in U.S. Pat. No. 4,398,411 wherein the vibration and recoil otherwise experienced during operation of a rivet bucking tool is absorbed in the tool housing with compressed air being introduced into a dampening chamber. The pressure of the reduced air from an outside source is made adjustable with valve means while a further O ring element in this tool construction is also reported to resiliently dampen forward impact by the reciprocating piston.

Still other type deformable attenuation means have been utilized in pneumatic impact tools to minimize vibration, including employment of elastomeric buffers and mechanical springs. For example, a hand-held pneumatic powered tool of this type is disclosed in U.S. Pat. No. 5,054,562 which is constructed of rigid parts isolated from each other by elastomeric shock-absorbing material arranged between the parts in laminar fashion in which certain of the layers are of a different Shore A hardness as respect each other. The layers are reported to be formed with different thicknesses which are introduced into an annular space between the parts in pourable condition, each layer being permitted to set-up before the next layer is poured, which results in bonding of the elastomeric layers to each other as well as to the parts. A novel supporting structure is reported to be disposed between the parts to space them in condition to receive the elastomeric material and the structure is permitted to remain between the parts in such isolated or shock-absorbing fashion so as to improve the vibration-minimizing characteristics of the overall construction. Elastomers reported to be useful for such device construction are any of the known liquid polyurethane types pourable at room temperature or up to about 100° F. and with decreasing Shore A hardness being exhibited in successive layers of the poured elastomer. In U.S. Pat. No. 5,407,018 there is also disclosed elastomeric attenuation means having a novel multi-part construction for impact tools to provide a still greater degree of vibration and noise attenuation. A still different vibration and noise attenuation construction for impact tools which employs oppositely biased metal springs is similarly disclosed in U.S. Pat. No. 4,359,225.

It is an object of the present invention, therefore, to provide still further improved means for vibration and noise attenuation in a pneumatic impact tool requiring only a relatively simple modification of the existing tool construction.

A still further object of the present invention is to provide the desired improvement in a distinctive manner involving cooperation between component parts of a multi-part attenuation means.

It is yet another object of the present invention to provide the desired improvement in a variety of pneumatic powered impact tools including the type employing a replaceable reciprocating impact member.

These and still further objects of the present invention will become apparent upon considering the following detailed description of the present invention.

SUMMARY OF THE INVENTION

A novel construction has now been discovered for a variety of pneumatic powered impact tools which serves more effectively to reduce both vibration and noise during device operation. Such improvement is primarily attributable to pneumatic dampening chamber means being provided in the present tool construction which undergoes compression as the reciprocating work member recoils. To achieve the desired dynamic effect requires the reciprocating work member to be affixed to a movable sleeve member while further including a resilient seal means to increase the dampening action. In general, the construction of a pneumatic powered impact tool operating in this improved manner includes a housing member having a central passageway, a closed end hollow sleeve member slidably engaged in the central passageway of said housing member which includes a free piston member movably disposed therein, a reciprocating impact member closing the front end of said sleeve member for cyclical engagement with said free piston member, a pneumatic valve mechanism closing the back end of said sleeve member for exerting pressurized fluid against the opposite ends of said free piston member, the back end of the central passageway in said housing member providing a pneumatic vibration dampening chamber which is compressed by rearward movement of said sleeve member, and resilient seal means disposed at the back end of said sleeve member for cooperative association with said vibration dampening means. Having the resilient seal means in the present device being provided as an O ring member formed with elastomeric material, such as rubber, enables such means to be directly affixed to the movable sleeve member in a conventional manner. With such construction, the O ring member actively assists the dampening chamber to absorb vibration and noise within the device itself.

To still further improve vibration and noise attenuation in the present device, mechanical spring means can be utilized in a particular manner assisting vibration isolation within the tool itself. Accordingly, having a pair of oppositely biased mechanical spring means disposed for engagement by the movable sleeve member in the present device so as to be alternately compressed when the sleeve member moves has been found to produce such benefit. A satisfactory structural configuration providing such desired cooperation in the present device employs a pair of helically shaped metal coil members directly encircling the movable sleeve member intermediate its ends. By such means, a significant reduction takes place in the vibration resulting from the inertial effects of piston motion in the present device. As will be demonstrated hereinafter, device construction in this manner further reduces vibration being transferred to the outer housing member by having both isolation and dampening means being included.

DETAILED DESCRIPTION OF THE PREFERRED EMBODIMENTS

Figure 1:
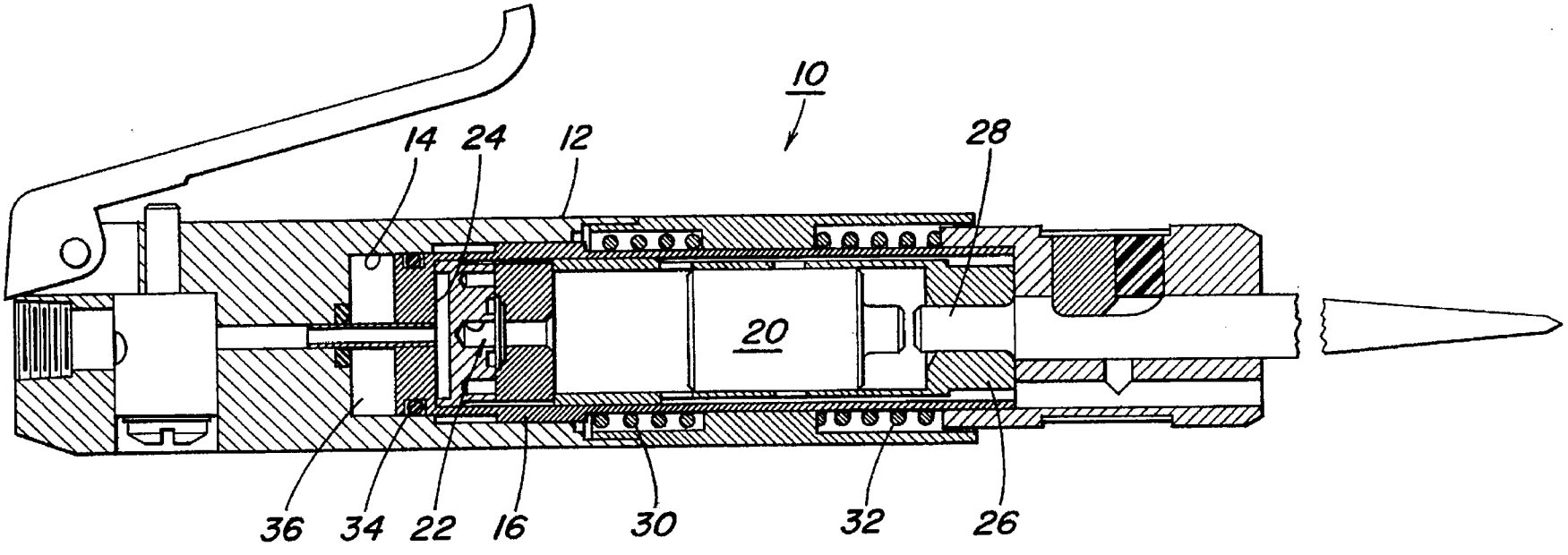
FIG. 1 is a side view partially in cross section for a representative hand-held pneumatic power tool according to the present invention.

Referring to the drawings, there is shown in FIG. 1 a side view partially in cross section for a representative hand-held pneumatic power tool 10 incorporating the presently improved vibration and noise attenuation means. As can be noted, the depicted tool construction is now commonly employed to remove weld flux scale in the metal industry and lacks handle means with the tool operator holding this device with a grip placed about the outer circumference of the tool housing 12. It is to be particularly further noted and understood, however, that the depicted hand-held tool represents only one kind of pneumatic powered impact tool device which can be advantageously operated with the present attenuation means hereinafter further described. The depicted outer housing 12 is of a hollow cylindrical construction having a central passageway 14 which incorporates a closed end hollow sleeve member 16 slidably engaged for reciprocal movement within the central passageway. A free piston cylinder 20 is also slidably engaged for reciprocal movement within hollow sleeve member 16 when actuated by a conventional pneumatic valve mechanism 22 closing the back end 24 of said sleeve member. The front end 26 of sleeve member 16 is closed with a reciprocating impact member 28, such as a chisel and the like, for cyclical engagement with the front end 26 of free piston cylinder 20. Pneumatic valve mechanism 22 supplies a pressurized gaseous discharge medium, such as air, to drive the free piston member forward and back in cooperation with cyclical movement caused by collision between the moving piston and impact member. Understandably, such collisions occur repeatedly when the forward moving piston contacts the impact member as well as when the piston is caused to move backward when disturbed by action of the recoiling impact member. A pair of oppositely biased mechanical spring means 30 and 32 also physically engage sleeve member 16 so as to be alternately compressed with sleeve movement and in doing so serve as a means reducing vibration transfer to the tool housing 12. Suitable spring means for this purpose include helically shaped metal coil members and the like.

The hollow back end 36 of central passageway 14 forms a pneumatic vibration dampening chamber when compressed by rearward movement of sleeve member 16. The dampening effect produced by such means effectively counteracts vibration caused when reciprocating impact member 28 encounters a workpiece thereby enabling vibrational effects to be absorbed within the tool device itself. Additional vibration dampening is achieved in the present device construction with incorporation of resilient seal means 34 which are physically disposed in the customary manner at the back end of sleeve member 16. Conventional O ring members formed with a suitable elastomeric material and physically secured to said sleeve member thereby cooperate with sleeve movement in providing the desired vibration and noise attenuation.

Figure 2:
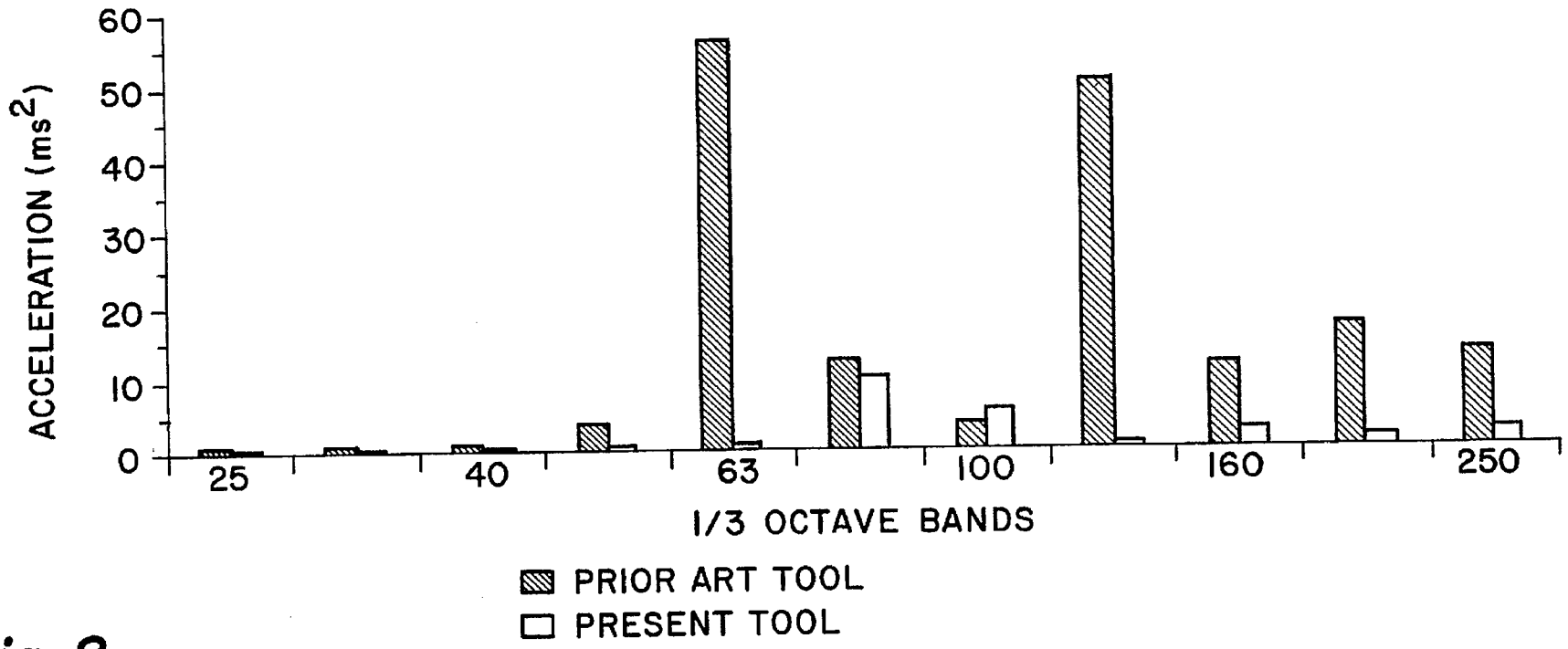
FIG. 2 is a bar graph depicting the vibration experienced with the FIG. 1 tool construction as compared with a prior art tool construction.

FIG. 2 is a bar graph affording a means of comparison between the FIG. 1 tool construction and the prior art hand-held pneumatic powered impact tool described in aforementioned U.S. Pat. No. 5,407,018 (FIG. 1) which lacks comparable vibration attenuation means. Specifically, a conventional dynamic signal analyzer instrument was employed for measurement of the vibration values reported on the present bar graph as acceleration G values (meters per second squared) for each of the tool devices being compared during a 400 minute time interval of tool operation. As can be seen, far less vibration was experienced during tool operation with the presently employed attenuation means in all vibration frequency bands to the extent of virtually experiencing no vibration in the lower ⅓ octave bands. The multi-part attenuation means herein employed thereby enables the pneumatic dampening means to provide a cushioning and vibration attenuating effect which is further accompanied by reduction of inertially produced vibration due to the cooperating spring components.

Decreased vibration and noise during operation of the hereinabove described impact tool entails cooperative dynamic association between the included movable sleeve and mechanical spring components. When said tool embodiment is simply hand-held without physically contacting the workpiece, vibrational effects are primarily inertial and the illustrated spring assembly serves to isolate vibration from being transferred to the outer tool housing. Upon physically contacting the workpiece with the reciprocating tool member, however, far greater vibration occurs from tool impact requiring attenuation now to be provided primarily with the illustrated movable sleeve means. In doing so, rearward sleeve movement causes a pneumatic dampening chamber to be formed which in combination with further included resilient seal means again reduces vibration transfer to the outer tool housing. Providing cooperative means which both isolate as well as dampen vibration effects in the present tool construction thereby promotes maximum control of tool operation.

It will be apparent from the foregoing description that a broadly useful and novel means has been provided enabling a variety of pneumatic powered impact tools to be operated in a superior manner. It is contemplated that modification can be made in the specific construction of the present attenuation means, including materials of construction as well as methods for construction other than herein illustrated, however, without departing from the spirit and scope of the present invention. For example, additional resilient seal means can be disposed at the front end of the movable sleeve member to still further assist with vibration reduction. Accordingly, it is intended to limit the present invention only by the scope of the appended claims.

What we claim as new and desire to secure by Letters Patent of the United States is:

1. A pneumatic powered impact tool having improved vibration attenuation which comprises:

(a) a housing member having a central passageway with front and back ends, (b) a closed end hollow sleeve member having front and back ends which is slidably engaged in the central passageway of said housing member and which includes a free piston member movably disposed therein with respect to both sleeve and housing members, (c) a reciprocating impact member closing the front end of said sleeve member for cyclical engagement with said free piston member, (d) a pneumatic valve mechanism closing the back end of said sleeve member for axially exerting pressurized fluid against opposite ends of said free piston member, (e) the back end of the central passageway in said housing member forming a pneumatic vibration dampening chamber devoid of mechanical spring means and with a volume which is compressed by rearward movement of said sleeve member, and (f) resilient seal means disposed at the back end of said sleeve member for cooperative association with said vibration dampening chamber.

2. The impact tool of claim 1 wherein the resilient seal means is formed with an elastomeric material.

3. The impact tool of claim 1 wherein the resilient seal means is an O-ring member.

4. The impact tool of claim 1 wherein the reciprocating impact member is a chipping tool.

5. The impact tool of claim 4 wherein the chipping tool is physically secured to the sleeve member with retainer means enabling replacement.

6. A pneumatic powered impact tool having improved vibration attenuation which comprises:

(a) a housing member having a central passageway, with front and back ends, (b) a closed end hollow sleeve member having front and back ends which is slidably engaged in the central passageway of said housing member and which includes a free piston member movably disposed therein with respect to both sleeve and housing members, (c) a pair of oppositely biased mechanical spring means engaged by said sleeve member so as to be alternately compressed when the sleeve member moves, (d) a reciprocating impact member closing the front end of said sleeve member for cyclical engagement with said free piston member, (e) a pneumatic valve mechanism closing the back end of said sleeve member for axially exerting pressurized fluid against opposite ends of said free piston member, (f) the back end of the central passageway in said housing member forming a pneumatic vibration dampening chamber devoid of mechanical spring means and with a volume which is compressed by rearward movement of said sleeve member, and (g) resilient seal means disposed at the back end of said sleeve member for cooperative association with said vibration dampening chamber.

7. The impact tool of claim 6 wherein each mechanical spring means comprises a helically shaped metal coil member.

8. The impact tool of claim 7 wherein each coil member is directly affixed to said sleeve member.

9. The impact tool of claim 8 wherein said coil members are disposed intermediate the ends of said sleeve member.

10. The impact tool of claim 6 wherein the resilient seal means is formed with an elastomeric material.

11. The impact tool of claim 6 wherein the resilient seal means is an O-ring member.

12. The impact tool of claim 6 wherein the reciprocating impact member is a chipping tool.

13. The impact tool of claim 12 wherein the chipping tool is physically secured to the sleeve member with retainer means enabling replacement.

14. A hand-held pneumatic powered chipping tool having improved vibration attenuation which comprises:

(a) a cylindrical housing having a cylindrical central passageway with front and back ends, (b) a closed end hollow cylindrical sleeve member having front and back ends which is slidably engaged in the central passageway of said housing and which includes a free piston cylinder movably disposed therein with respect to both sleeve and housing members, (c) a pair of oppositely biased metal spring coils disposed intermediate the ends of said sleeve member for engagement therewith so as to be alternately compressed when the sleeve member moves, (d) a replaceable reciprocating chisel member closing the front end of said sleeve member for cyclical engagement with said free piston cylinder and detachably secured thereto with retainer means, (e) a pneumatic valve mechanism closing the back end of said sleeve member which axially supplies pressurized air to drive the piston cylinder forward and back cyclically within said sleeve member, (f) the back end of the central passageway in said housing forming a pneumatic vibration dampening cylindrical chamber deviod of mechanical spring means and with a volume which is compressed by rearward movement of said sleeve member, and (g) elastometric seal means having an O-ring configuration which are affixed to the back end of the said sleeve member for cooperative association with said vibration dampening cylindrical chamber.

* * * * *